US007812720B2

(12) United States Patent
King et al.

(10) Patent No.: US 7,812,720 B2
(45) Date of Patent: Oct. 12, 2010

(54) APPARATUS AND METHOD FOR MONITORING A COMPONENT OF A WIRELESS COMMUNICATION NETWORK TO DETERMINE WHETHER THE COMPONENT HAS BEEN TAMPERED WITH, DISABLED AND/OR REMOVED

(75) Inventors: Glenn Andrew King, Middletown, MD (US); Jennifer Lynn King, Middletown, MD (US)

(73) Assignee: Cambien Corporation, Fredrick, MD (US)

( * ) Notice: Subject to any disclaimer, the term of this patent is extended or adjusted under 35 U.S.C. 154(b) by 559 days.

(21) Appl. No.: 11/785,273

(22) Filed: Apr. 17, 2007

(65) Prior Publication Data

US 2008/0258912 A1 Oct. 23, 2008

(51) Int. Cl.
*G08B 1/08* (2006.01)
*G08B 21/00* (2006.01)

(52) U.S. Cl. ..... 340/539.31; 340/540; 340/635

(58) Field of Classification Search ..... 340/539.31, 340/540, 635

See application file for complete search history.

(56) References Cited

U.S. PATENT DOCUMENTS 4,746,909 A * 5/1988 Israel et al. ..... 340/568.1
5,191,314 A * 3/1993 Ackerman et al. ..... 340/542
2006/0245445 A1* 11/2006 Sumer et al. ..... 370/419

* cited by examiner

*Primary Examiner*—Daniel Wu
*Assistant Examiner*—John F Mortell
(74) *Attorney, Agent, or Firm*—Merek, Blackmon & Voorhees, LLC

(57) ABSTRACT

A method and apparatus for monitoring one or more components of a wireless communication network. Preferably, an alarm system is linked to one or more components of a wireless communication network to determine whether the one or more components have been tampered with, removed or otherwise disabled. The monitored component can be a ground system in a cellular telephone network. The alarm system can include at least one conductive path linked to a ground bar of a ground system in a cellular telephone network such that if the ground bar is removed from the cellular telephone network the at least one conductive path is severed thereby generating an alarm signal. The alarm signal may take the form of an audible alarm (e.g., a horn), a visual alarm (e.g., flashing lights) and/or a signal transmitted to a monitoring station indicating that the ground bar has been removed and the equipment at the tower site is now vulnerable to lighting strikes. Preferably, the alarm system is configured such that it can be readily installed in existing sites as well as new sites. The at least one conductive path may be linked to two or more ground bars in series such that removal of either ground bar will result in the generation of an alarm signal. Alternatively, multiple ground bars at a single tower site can be monitored independent of each other.

8 Claims, 5 Drawing Sheets

APPARATUS AND METHOD FOR MONITORING A COMPONENT OF A WIRELESS COMMUNICATION NETWORK TO DETERMINE WHETHER THE COMPONENT HAS BEEN TAMPERED WITH, DISABLED AND/OR REMOVED

FIELD OF THE INVENTION

The present invention is directed to wireless communication networks including but not limited to cellular telephone networks. More particularly, the present invention is directed to a method and apparatus for monitoring one or more components of a wireless communication network to determine whether the component has tampered with, disabled and/or removed.

BACKGROUND OF THE INVENTION

Wireless communication networks represent a considerable investment and must be adequately protected to preserve the same. For example, wireless communication networks in the form of cellular telephone networks typically include a multitude of short range towers sites each providing coverage for an area or "cell." The multitude of short range tower sites form an area covered by the network. The tower sites typically include at least one large tower having one or more antennas for receiving a signal sent from a cellular telephone. The tower sites also include one or more shelters (e.g. buildings) housing the equipment of a particular service provider for processing the calls received at the tower site. The towers and the related equipment represent a huge financial investment as well as a considerable investment in time erecting and maintaining the tower sites. Obviously, it is desirable to protect both of these considerable investments.

The damage that can be caused by a lighting strike to the tower and the related equipment located at a tower site is significant. Accordingly, ground systems have been developed to protect the towers and related equipment from a lighting strike. However, if the grounding system has been tampered with, a component of the grounding system removed (e.g., theft of a ground bar) or the grounding system is otherwise disabled, the tower and related equipment are vulnerable to damage resulting from lighting strikes.

Accordingly, there is a significant need for an apparatus and method for monitoring components of wireless communications networks including but not limited to grounding systems in cellular telephone networks in order to adequately protect the significant investment that wireless communication networks represent.

OBJECTS AND SUMMARY OF THE INVENTION

An object of a preferred embodiment of the present invention is to provide a novel and unobvious method and apparatus for monitoring one or more components of a wireless communications network to determine whether the component has been tampered with, removed and/or otherwise disabled.

Another object of a preferred embodiment of the present invention is to provide an alarm and/or monitoring system that can readily determine when a ground system of a wireless communication network has been damaged.

A further object of a preferred embodiment of the present invention is to provide an alarm and/or monitoring system that can readily determine whether a component in a wireless communication network has been damaged or disabled.

Yet another object of a preferred embodiment of the present invention is to provide a cost effective means for monitoring one or more components of a wireless communication network.

Yet still another object of a preferred embodiment of the present invention is to provide a cost effective means for monitoring the ground system at one or more tower sites in a cellular communication network to determine whether the ground system has been disabled.

Still a further object of a preferred embodiment of the present invention is to provide a kit including an alarm system for monitoring the ground system at one or more tower sites in a cellular communication network that can be readily installed with minimal adaptation of an existing tower site.

A further object of a preferred embodiment of the present invention is to provide an alarm system for monitoring the ground system at one or more tower sites in a cellular communication network that is linked to one or elements of the ground system (e.g., the ground bar) such that if the element is removed, the alarm system generates a corresponding alarm signal (e.g. an audible alarm, a visible alarm and/or an alarm signal transmitted to a remote monitoring location).

It must be understood that no one embodiment of the present invention need include all of the aforementioned objects of the preferred embodiments of present invention. Rather, a given embodiment may include one or none of the aforementioned objects. Accordingly, these objects are not to be used to limit the scope of the claims of the present invention.

In summary, one embodiment of the present invention is directed to a kit for use with a ground bar of a wireless communication network for detecting removal of the ground bar from a predetermined location in the wireless communication network. The kit includes an alarm system to detect removal of the ground bar from a predetermined location in the wireless communication network. The alarm system, when installed in the wireless communication network, is operably associated with the ground bar such that removal of the ground bar generates a signal indicating removal of the ground bar from a predetermined location in the wireless communication network.

Another embodiment of the present invention is directed to an apparatus for monitoring a component of a wireless communication network for detecting removal of the component from a predetermined location in the wireless communication network. The apparatus includes an alarm system for detecting removal of the component from a predetermined location in the wireless communication network. The alarm system is operably associated with the component such that the component cannot be readily removed from the predetermined location in the wireless communication network without destroying at least a portion of the alarm system. The alarm system is configured to generate a signal upon destruction of the at least a portion of the alarm system caused by removal of the component.

A further embodiment of the present invention is directed to a method of monitoring a ground system for a wireless communication network including the steps of: (a) providing an alarm system for detecting disablement of the ground system at a predetermined location in the wireless communication network; and, (b) operably associating the alarm system with the ground system such that disablement of a predetermined portion of the ground system generates an alarm signal.

DETAILED DESCRIPTION OF THE PREFERRED EMBODIMENTS OF THE INVENTION

The most preferred forms of the invention will now be described with reference to FIGS. 1-7. The appended claims are not limited to the most preferred forms and no term used herein is to be given a meaning other than its ordinary meaning unless otherwise stated.

FIGS. 1 Through 7

Figure 1:
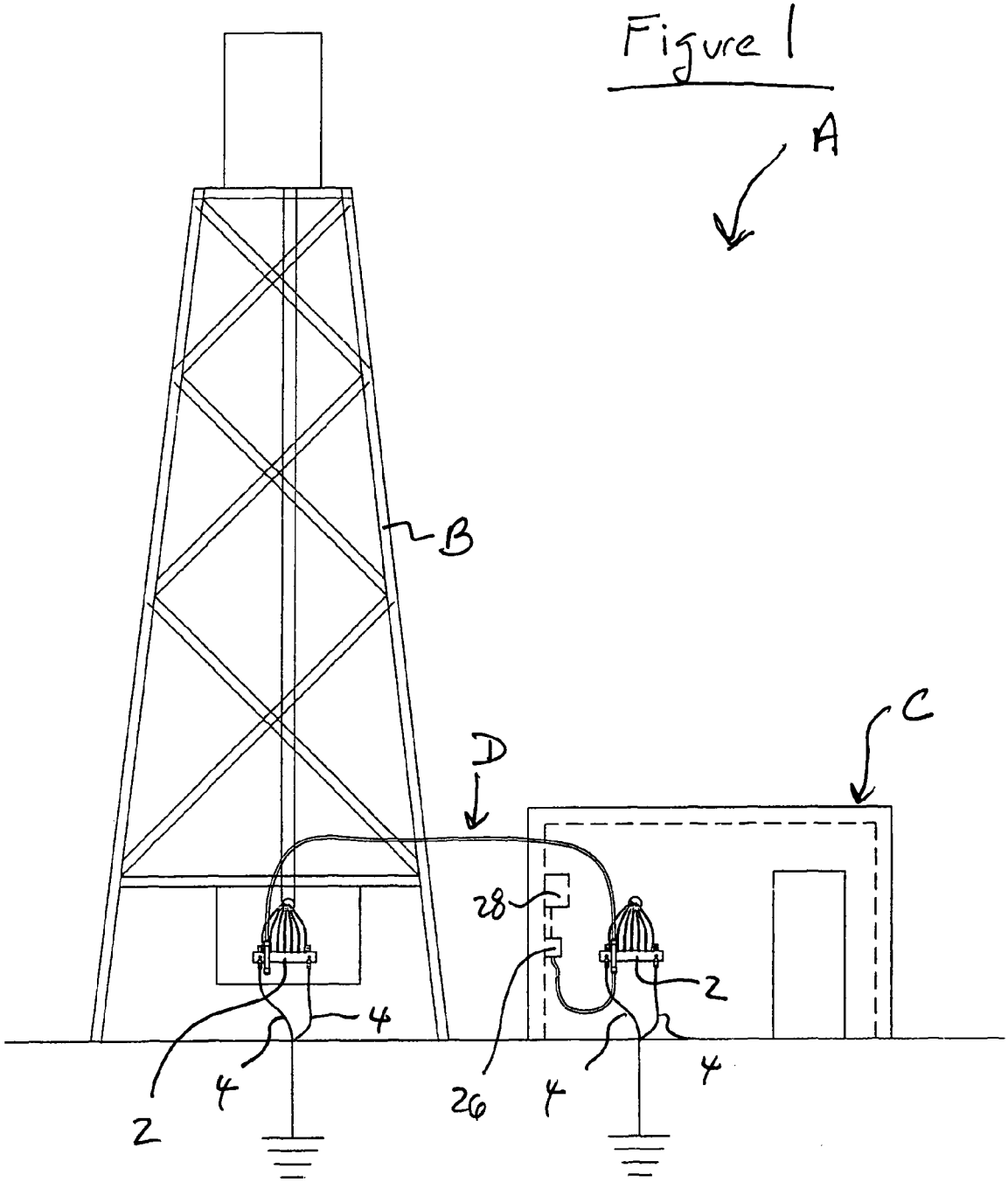
FIG. 1 is an illustration of a preferred embodiment of the present invention utilized to monitor a ground system at a cellular tower site in a cellular communication network.

Referring to FIG. 1, a cellular tower site A is illustrated in one of many possible configurations. While the preferred embodiment of the present invention is described with reference to a ground member in a ground system at a cellular tower site of a cellular telephone network, the present invention is in no way limited to monitoring a ground member in a cellular telephone network. Rather, the present invention can be used in any network to monitor numerous different components.

Figure 3:
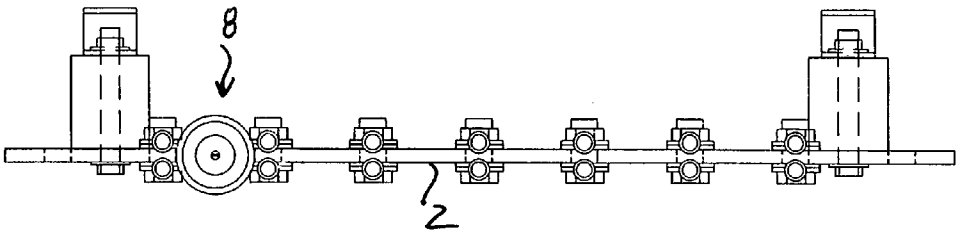
FIG. 3 is a plan view of the ground bar with a portion of the preferred embodiment of the present invention mounted thereon.
Figure 2:
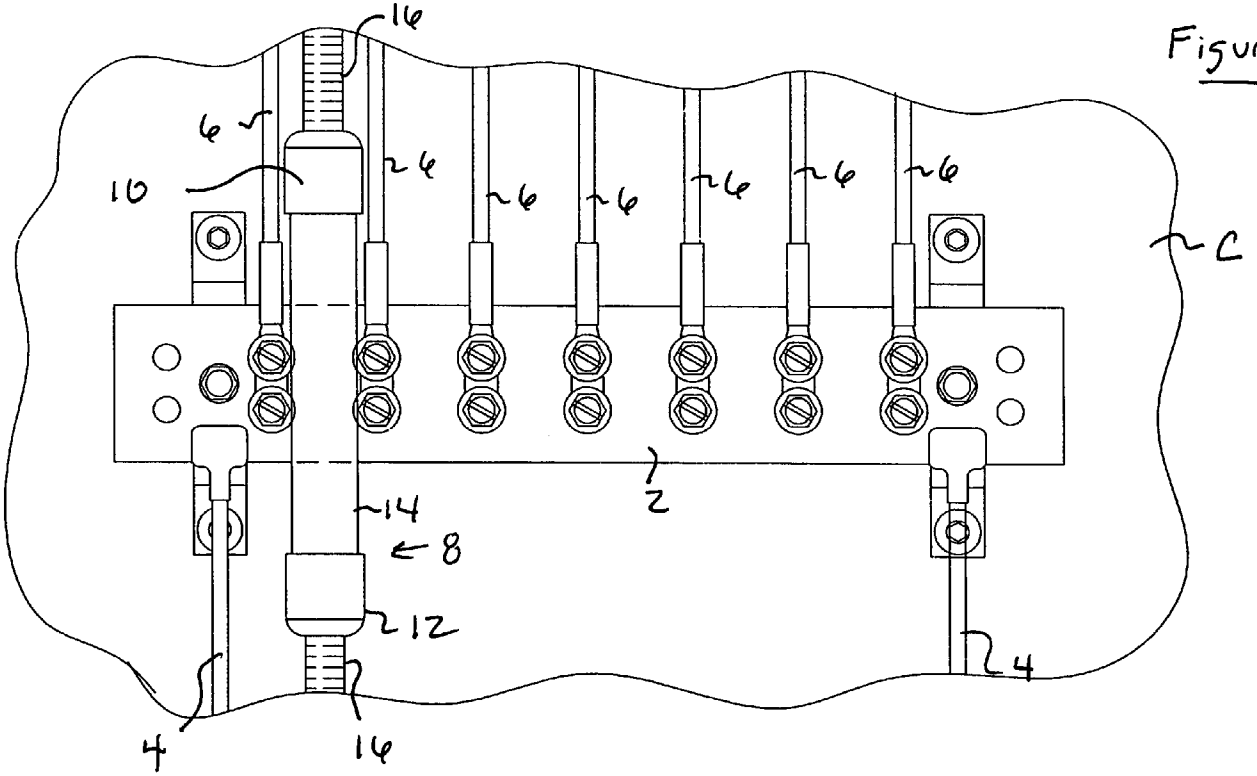
FIG. 2 is a front view of a ground bar mounted to an external wall of a building at a cellular tower site with various connections secured thereto to ground the cellular communication network. A portion of the preferred embodiment of the present invention is shown mounted on the ground bar.
Figure 4:
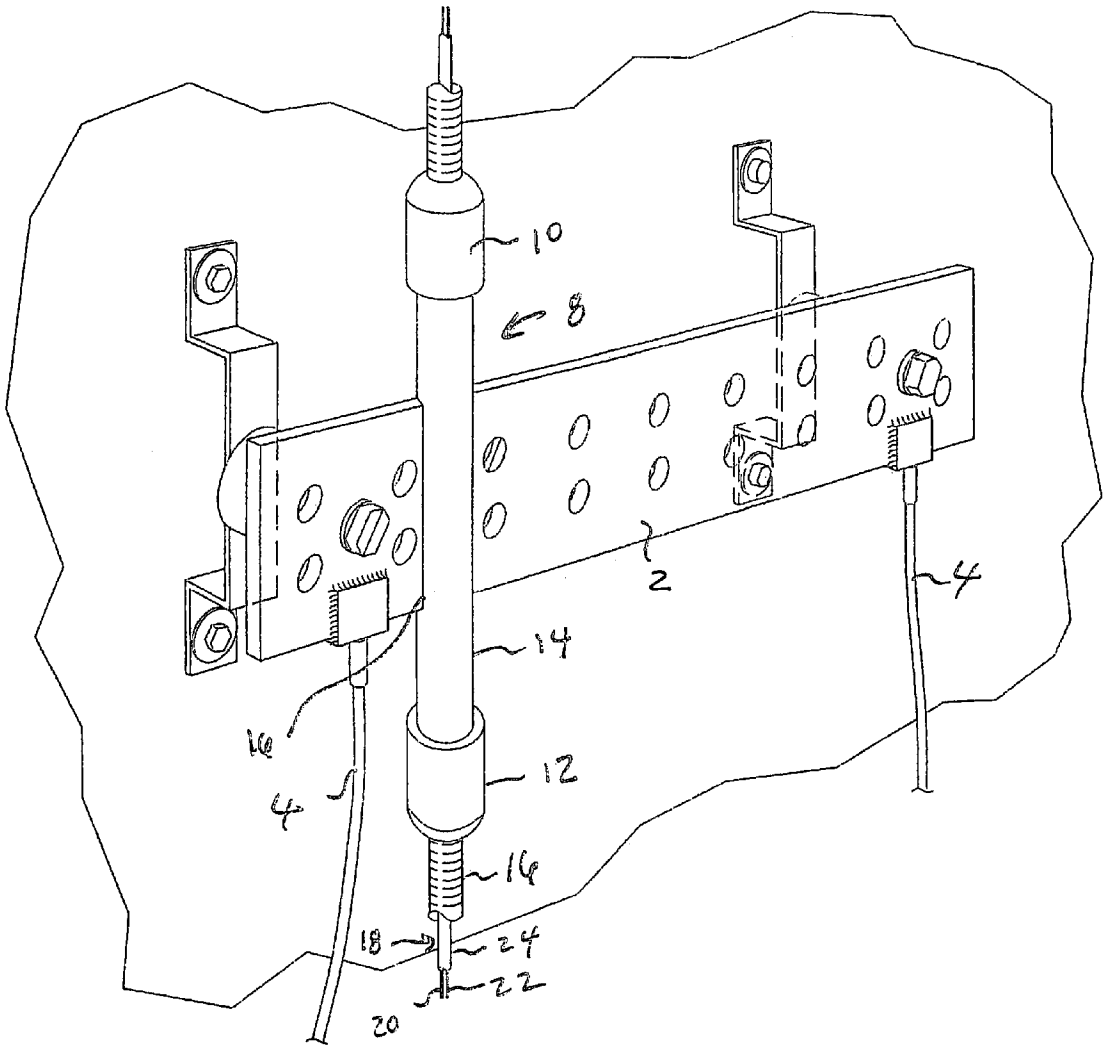
FIG. 4 is perspective view of the ground bar mounted to the external wall of a building at a cellular tower site with various conventional connections to the ground bar removed to better illustrate one aspect of a preferred embodiment of the present invention. A portion of the preferred embodiment of the present invention is shown mounted on the ground bar.
Figure 6:
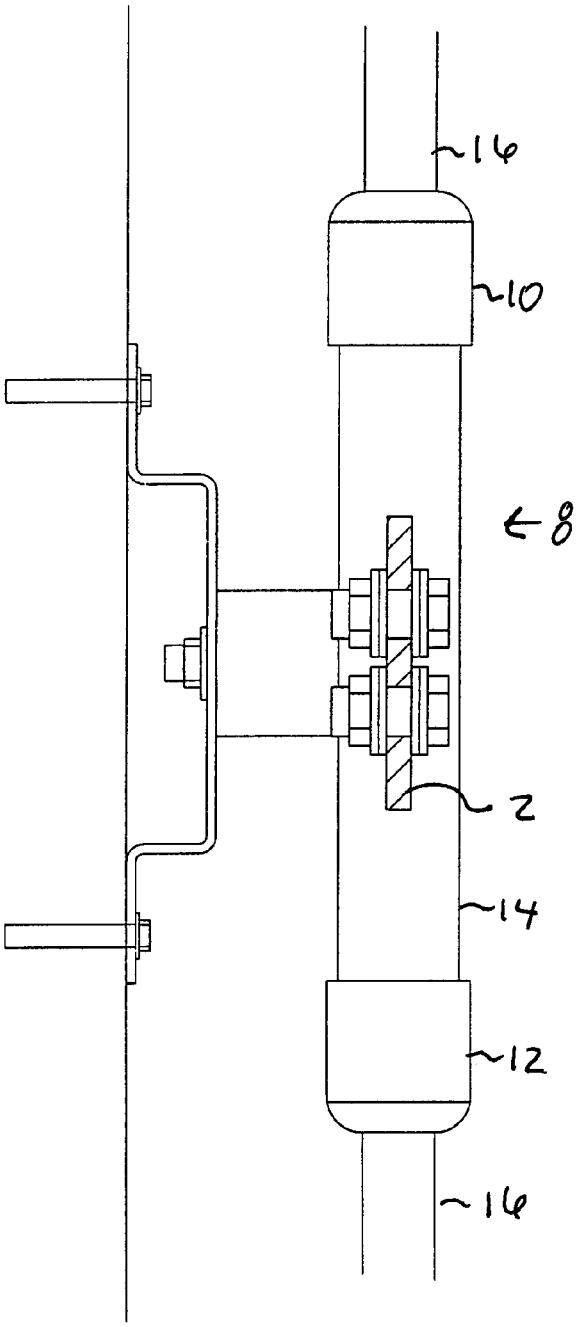
FIG. 6 is a fragmentary cross-sectional view through a portion of the ground bar with the alarm housing formed in accordance with a preferred embodiment of the present invention operably associated therewith.

The cellular tower site A includes one or more towers B and one or more buildings C housing the equipment for processing telephone calls received by tower B. As is typical, ground members 2 (e.g. ground bars) are mounted on the tower B and building C. While only one ground bar 2 is shown on tower B, there may be multiple ground members 2 at towers B, one for each service provider using cellular tower site A. Further, there may be multiple buildings C and a corresponding ground member 2 at each site A, one for each different service provider using tower site A. As shown in FIGS. 1, 2 and 4, a pair of metal rods 4 are connected to and extend downwardly from opposite ends of ground members 2. The metal rods 4 are in turn connected to ground rings buried in the earth adjacent tower B and building C in a conventional manner. As shown in FIGS. 2 and 3, a number of system elements are connected to ground member 2 by lines 6 to protect the equipment at the cellular tower site A from damage.

The previously described ground system is typically used to prevent damage to the equipment at the cellular tower site A from for example lighting strikes. If the grounding system is disabled by, for example, removal of the ground member 2, the equipment at cellular tower site A will be subject to damage or destruction if the site A is struck by lighting. Accordingly, it is beneficial to monitor the ground system to make sure that it has not been disabled.

Alarm system D, in its most preferred form, monitors ground members 2 to determine whether they have been removed thereby disabling the ground system at site A. Referring to FIGS. 1, 2 and 4, alarm system D includes housing 8 mounted on each ground member 2. Preferably, housing 8 is formed from a non-conductive material (e.g., polyvinylchloride). Housing 8 includes a pair of ends caps 10 and 12 that are adhered to or otherwise secured to body 14. Body 14 can be formed as two pieces with an enlarged slot 16 formed therein to receive ground member 2. In this manner, body 14 can be readily mounted on ground member 2. Alternatively, body 14 can be formed as a single piece of PVC with a suitably sized slot formed therein allowing the body 14 to slide over ground member 2 from above. Once body 14 is mounted on ground member 2, end caps 10 and 12 may be glued or otherwise secured thereto thereby forming housing 8 on ground member 2.

Figure 5:
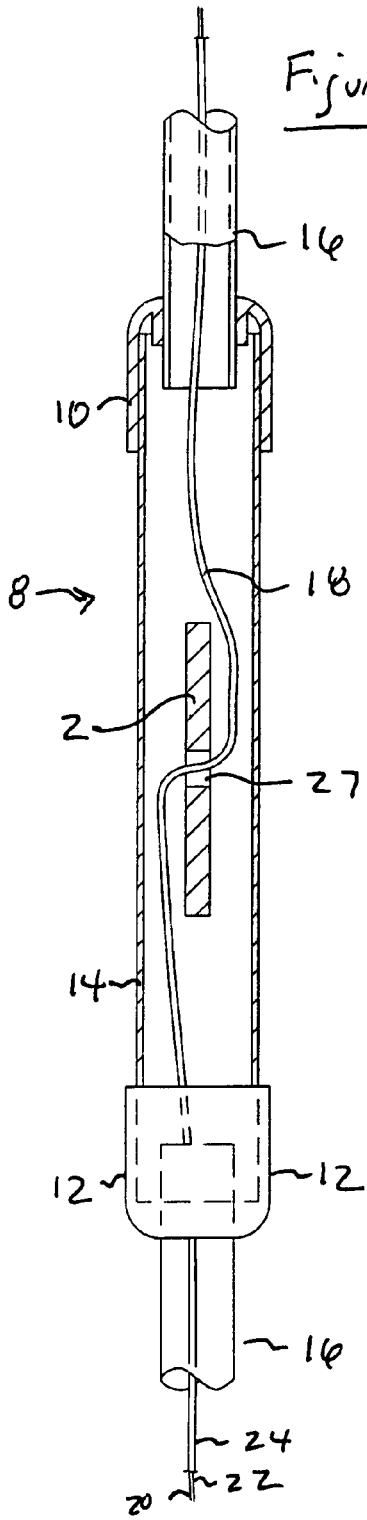
FIG. 5 is a fragmentary cross-sectional view of an alarm housing formed in accordance with a preferred embodiment of the present invention.

A protective conduit 16 may extend from each of ends caps 10 and 12 of housing 8 mounted on building C. The protective conduit 16 can be a liquid tight, flexible, non-metallic conduit (e.g., CARFLEX® conduit). Preferably, protective conduct 16 and housing 8 house all external lengths of a two-conductor cable 18 (i.e., all lengths of the cable that are located outside of building C). Cable 18 may have two wires 20 and 22 encased in an insulated covering 24 (e.g., #18 cable). As seen in FIG. 5, cable 18 preferably passes through an opening 27 extending through ground member 2. Preferably, opening 27 is disposed in housing 8.

Referring to FIG. 1, cable 18 is preferably connected at one end to surge arrestor 26 and alarm panel 28 located in building C. The other end of cable 18 is spliced and terminates in housing 30 mounted on ground member 2 secured to tower B to form a closed loop electrical path. Like the ground member 2 cable 18 is linked in such a manner that the ground member can not be readily removed without breaking the electrical path. For example, the two conductors can pas through an opening in ground member 2 and be spliced together. Should ground member 2 be removed, the electrical path would be broken as the conductor wires are severed or pulled apart. Housing 30 is configured in a virtually identical manner to housing 8. The only difference being that the lower end cap of housing 30 is sealed, i.e., cable 18 does not extend through the lower end cap. A voltage is applied to cable 18 to monitor the ground members 2 on the tower B and building C. It should be noted that while the ground members 2 on the tower B and building C are being monitored in series, the present invention is not limited to monitoring the ground members in series. For example, the ground members can be monitored independently of each other.

Because of the way that cable 18 is linked to ground members 2 on the tower B and building C, ground members 2 cannot be readily removed without severing or otherwise damaging cable 18 result in the electrical path being broken. A brake in the electrical path can be detected in any known manner. For example, alarm panel 28 can be used to detect a brake in the electrical path and generate an alarm. The alarm can be an audible alarm, a visual alarm and/or a signal transmitted to a remote monitoring site indicating that the ground system has been disabled and the equipment at the particular tower site is vulnerable to damage from lighting strikes.

As opposed to mounting housing 8 on ground member 2, housing 8 can be mounted on either of rods 4 associated with a particular ground member 2. Cable 18 can be wrapped around the corresponding rod 4. Therefore, if the ground system is tampered with by severing one or more of rods 4, an alarm is generated in a similar manner to that described above.

Figure 7:
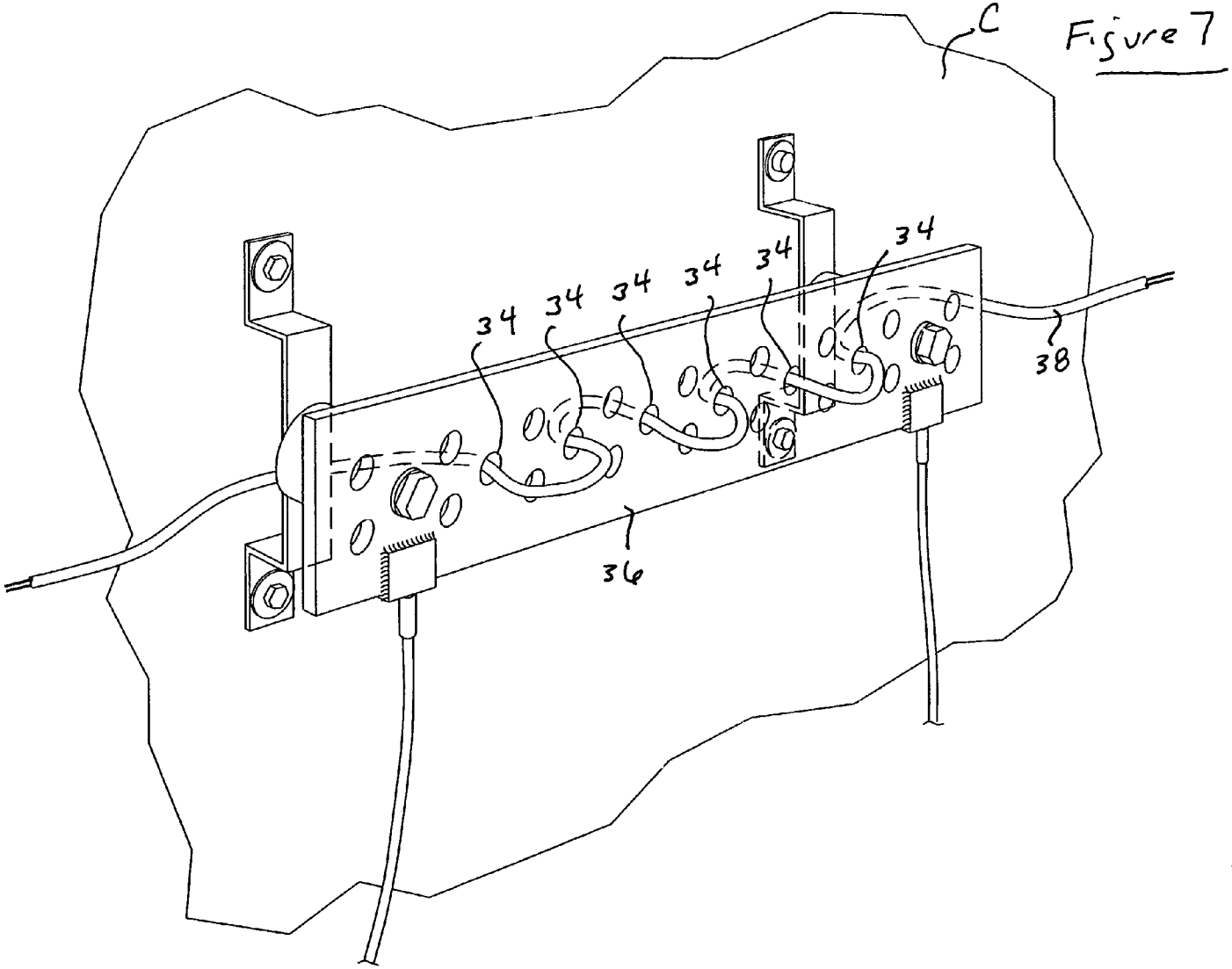
FIG. 7 is a perspective view of an alternative embodiment of the present invention.

Another alternative configuration is depicted in FIG. 7. A plurality of openings 34 can be formed in ground bar 36. A cable 38 similar to cable 18 can be threaded through the openings 34 formed along the length of ground bar 36. Accordingly, if the ground bar 36 is cut at various portions along its length, an alarm is generated. Cable 38 could be protected and concealed with a housing similar to housing 8. Cable 38 may also be protected by a protective conduit similar to conduit 16.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. An apparatus for monitoring a ground bar of a wireless communication network for detecting removal of said ground bar from a predetermined location in the wireless communication network, said apparatus comprising:

(a) an alarm system for detecting removal of the ground bar from a predetermined location in the wireless communication network, said alarm system being operably associated with said ground bar such that said ground bar cannot be readily removed from the predetermined location in the wireless communication network without destroying at least a portion of said alarm system, said alarm system being configured to generate a signal upon destruction of the at least a portion of said alarm system caused by removal of said ground bar; and, (b) said alarm system including a housing mounted on said ground bar and at least one conductive path passing through said housing and passing through an opening in the ground bar, said opening in said ground bar being disposed in said housing.

2. An apparatus as recited in claim 1, wherein:

(a) said housing includes a tubular body and first and second end caps.

3. An apparatus as recited in claim 2, wherein:

(a) said alarm system includes and alarm panel, said alarm panel is removed from said housing.

4. An apparatus as recited in claim 3, wherein:

(a) said ground bar is disposed on a tower and said alarm panel is disposed in a building.

5. An apparatus as recited in claim 4, wherein:

(a) said at least one conductive path terminates at said ground bar disposed on said tower.

6. An apparatus for monitoring a ground system of a wireless communication network for detecting disablement of said ground system, the ground system having at least a first ground bar and a second ground bar, said apparatus comprising:

(a) an alarm system for detecting removal of either said first ground bar or said second ground bar from a predetermined location in the wireless communication network, said alarm system including a first housing mounted on said first ground bar and a second housing mounted on a second ground bar and at least one conductive wire extending from said first housing to said second housing such that neither said first ground bar nor said second ground bar can be readily removed from their predetermined locations in the wireless communication network without destroying the at least one conductive wire.

7. An apparatus as set forth in claim 6, wherein:

(a) said at least one conductive wires extends through said first housing and terminates in said second housing.

8. An apparatus as set forth in claim 7, wherein:

(a) said at least one conductive wire extends through an opening in said first ground bar, said first opening being located in said first housing.

* * * * *